US010040123B2

(12) United States Patent
Rengarajan et al.

(10) Patent No.: US 10,040,123 B2
(45) Date of Patent: Aug. 7, 2018

(54) METHODS OF MILLING CARBIDE AND APPLICATIONS THEREOF

(71) Applicant: Kennametal India Limited, Bangalore (IN)

(72) Inventors: Raghavan Rengarajan, Bangalore (IN); Gopalrao Sivaraman, Bangalore (IN); Ramesh Sathyanarayan Rao, Bangalore (IN); Alam Rukhsar, Sundargarh (IN); Jagannath Vaishali, Mangalore (IN)

(73) Assignee: Kennametal India Limited, Kamataka (IN)

( * ) Notice: Subject to any disclaimer, the term of this patent is extended or adjusted under 35 U.S.C. 154(b) by 632 days.

(21) Appl. No.: 14/271,834

(22) Filed: May 7, 2014

(65) Prior Publication Data

US 2014/0341772 A1 Nov. 20, 2014

(30) Foreign Application Priority Data

May 16, 2013 (IN) ..... 2173/CHE/2013

(51) Int. Cl.
*B22F 9/04* (2006.01)
*B02C 17/18* (2006.01)
(Continued)

(52) U.S. Cl.
CPC ..... *B22F 9/04* (2013.01); *B02C 17/18* (2013.01); *B02C 17/186* (2013.01); *B02C 19/0056* (2013.01); *B02C 23/06* (2013.01); *B22F 3/12* (2013.01); *C22C 1/051* (2013.01); *C22C 29/08* (2013.01); *B22F 2009/043* (2013.01); *B22F 2999/00* (2013.01)

(58) Field of Classification Search
None
See application file for complete search history.

(56) References Cited

U.S. PATENT DOCUMENTS 1,913,100 A 6/1933 Balke
2,814,566 A 11/1957 Glaser
(Continued)

FOREIGN PATENT DOCUMENTS

EP 2055386 * 10/2008
GB 1448953 A 9/1976
(Continued)

OTHER PUBLICATIONS

Perez, R.J. "Grain size stability of nanocrystalline cryomilled fe-3wt.% al alloy" Nanostructured Materials. (1997). 9. p. 71-74.*
(Continued)

*Primary Examiner* — Colleen P Dunn
*Assistant Examiner* — Nicholas A Wang
(74) *Attorney, Agent, or Firm* — Larry R. Meenan

(57) ABSTRACT

In one aspect, methods of milling carbide are described herein. A method of milling carbide comprises placing a particulate composition comprising carbide in a vessel containing milling media and placing an additive in the vessel, the additive undergoing evaporation or sublimation to provide a non-oxidative atmosphere in the vessel. The carbide particles are comminuted with the milling media in the non-oxidative atmosphere.

32 Claims, 2 Drawing Sheets

(a)

(b)

(51) Int. Cl.

| | |
|---|---|
| ***B02C 19/00*** | (2006.01) |
| ***B22F 3/12*** | (2006.01) |
| ***B02C 23/06*** | (2006.01) |
| ***C22C 1/05*** | (2006.01) |
| ***C22C 29/08*** | (2006.01) |

(56) References Cited

U.S. PATENT DOCUMENTS

| | | | | |
|---|---|---|---|---|
| 4,934,608 | A | 6/1990 | Sylla et al. | |
| 2006/0153728 | A1* | 7/2006 | Schoenung | B22F 9/04 419/32 |
| 2011/0020163 | A1* | 1/2011 | Nilen | C22C 29/02 419/10 |
| 2012/0040183 | A1* | 2/2012 | Kelkar | B22F 3/1035 428/367 |
| 2012/0289559 | A1* | 11/2012 | Niwa | B02C 17/16 514/391 |

FOREIGN PATENT DOCUMENTS

| | | | |
|---|---|---|---|
| WO | 2012021254 | A1 | 2/2012 |
| WO | 2012098102 | A1 | 7/2012 |

OTHER PUBLICATIONS

May 19, 2014—Official_Action.

Tungsten Carbide Properties, article online, www.carbideprocessors.com/pages/carbide-parts/tungsten-carbide-properties.html, 1 page.

* cited by examiner (a) (b)

(a) (b)

(a) (b)

(a) (b)

METHODS OF MILLING CARBIDE AND APPLICATIONS THEREOF

RELATED APPLICATION DATA

The present application hereby claims priority pursuant to 35 U.S.C. § 119(a) to Indian Patent Application 2173/CHE/2013 filed May 16, 2013, which is hereby incorporated by reference in its entirety.

FIELD

The present invention relates to methods of milling carbide powder and, in particular, to solvent-free milling of carbide powder.

BACKGROUND

Of the various methods of producing tungsten carbide, carburization of tungsten metal through the addition of controlled amounts of carbon black is preferred. Control of the carbon black content permits the production of stoichiometric tungsten carbide with a fractional excess of free carbon. Carbon deficiency is unfavorable as it results in the formation of the brittle eta (η) phase in the final sintered product. Carburization is administered in the presence of hydrogen in a temperature range of 1400 to 2600° C. Temperature of the carburization process is closely controlled and generally kept as low as practical to avoid excessive grain growth in the formed tungsten carbide. The resulting carburized cake is subjected to milling and sieving operations to provide tungsten carbide powder of suitable particle size for combination with other powder species in the production of various grade powders.

Grade powders, for example, can include tungsten carbide mixed with metallic binder and/or additions of other transition metal carbides such as titanium carbide, tantalum carbide and niobium carbide. A mixture of tungsten carbide and metallic binder is subjected to rigorous milling to fracture large carbide crystallites and to distribute the metallic binder throughout the carbide composition. Milling is typically administered with a ball mill or attritor wherein organic liquid or solvent is used to prevent oxidation of the carbide. Organic solvent of acetone or heptane, for example, can be added to the milling drum or attritor tank for oxidation prevention. Employment of organic liquids or solvents can complicate the milling process as such liquids can be flammable and require onerous handling protocols. Further, organic liquid must be removed after completion of the milling, thereby requiring additional processing steps and cost for the production of grade powders.

SUMMARY

In one aspect, methods of milling carbide are described herein which, in some embodiments, can offer advantages over prior milling processes. Methods described herein, for example, can be administered in the absence of milling liquid while sufficiently inhibiting carbide oxidation during the milling process. Removing solvent from the milling process realizes efficiencies such as a reduction in processing steps for grade powder production and savings from the elimination of milling liquid and associated handling requirements. A method of milling carbide described herein comprises placing a particulate composition comprising carbide in a vessel containing milling media and placing an additive in the vessel, the additive undergoing evaporation or sublimation to provide a non-oxidative atmosphere in the vessel. The carbide particles are comminuted with the milling media in the non-oxidative atmosphere. In some embodiments, establishing a non-oxidative atmosphere with the additive precludes the use of milling liquid in the vessel. Further, the additive can be present in an amount sufficient to provide the non-oxidative atmosphere at a positive pressure in the vessel, thereby obstructing ingress of ambient air or oxygen.

In another aspect, methods of making cemented carbide articles are described herein. A method of making a cemented carbide article comprises placing a particulate composition comprising carbide and metallic binder in a vessel containing milling media and placing an additive in the vessel, the additive undergoing evaporation or sublimation to provide a non-oxidative atmosphere in the vessel. The carbide particles are comminuted with the milling media and associated with the metallic binder under the non-oxidative atmosphere and removed from the vessel. The comminuted particulate composition is consolidated into a green compact and sintered to provide the cemented carbide article. In some embodiments, the sintered carbide article is subjected to hot isostatic pressing to further increase densification.

In a further aspect, apparatus for milling carbide are described herein. An apparatus for milling carbide comprises a vessel and milling media in the vessel. The vessel also comprises an additive undergoing evaporation or sublimation to provide a non-oxidative atmosphere in the vessel for the milling operation. The additive can be present in an amount sufficient to provide the non-oxidative atmosphere at a positive pressure in the vessel, thereby obstructing ingress of ambient air or oxygen.

These and other embodiments are described further in the detailed description which follows.

DETAILED DESCRIPTION

Figure 1:
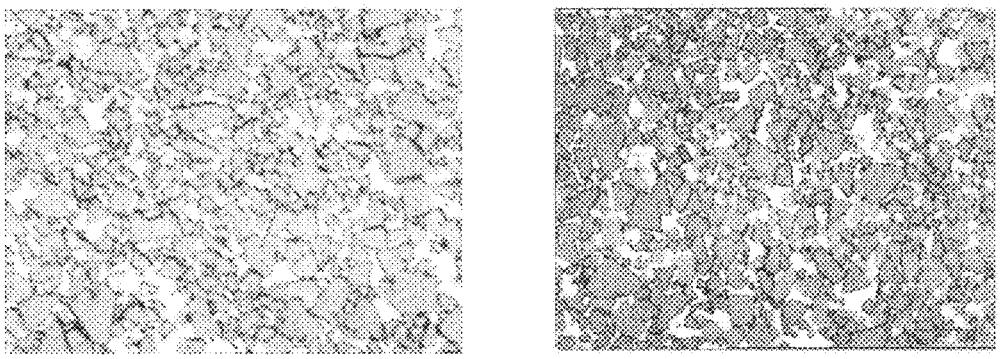
FIG. 1 illustrates cemented tungsten carbide produced according to one embodiment of a method described herein in comparison to a prior method.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

I. Methods of Milling Carbide and Cemented Carbide Article Made Therefrom

In one aspect, methods of milling carbide are described herein. A method of milling carbide comprises placing a particulate composition comprising carbide in a vessel containing milling media and placing an additive in the vessel, the additive undergoing evaporation or sublimation to provide a non-oxidative atmosphere in the vessel. The carbide particles are comminuted with the milling media in the non-oxidative atmosphere.

Turning now to specific steps, a method described herein comprises placing a particulate composition in a vessel containing milling media. Structural particulars of the vessel can be dependent on the type of milling apparatus employed. In some embodiments, the vessel is a milling drum of a ball mill. Alternatively, the vessel can be a tank associated with an attritor. The vessel can have any desired geometry and volume not inconsistent with the objectives of the present invention. In some embodiments, for example, the vessel has a volume of at least 5 liters or at least 100 liters. The vessel can have a volume in the range of 5 liters to 2500 liters. A vessel can be generally constructed of steel, such as stainless steel or other alloy. In some embodiments, a vessel is lined with ceramic, plastic or rubber. Additionally, a vessel can be jacketed for temperature management during milling operations.

Milling media in the vessel can have any size and geometry not inconsistent with the objectives of the present invention. Milling media can be spherical or irregular-shaped demonstrating diameters in the range of 3-50 mm or 8-30 mm. Further, milling media can be formed of a variety of materials. Milling media, for example, can be carbon steel, chrome steel, stainless steel, alloy, carbide including tungsten carbide, ceramic, zirconium or flintstones. Tungsten carbide milling media can be cemented tungsten carbide with cobalt or cobalt alloy binder. Moreover, ceramic milling media includes silicon nitride, silicon carbide, steatite, alumina, zirconia toughened alumina and zirconium oxide stabilized with magnesia, yttria or rare earth.

As described herein, a particulate composition comprising carbide is added to the vessel containing the milling media. Particulate carbide added to the vessel can comprise one or more transition metal carbides. In some embodiments, particulate carbide added to the vessel comprises carbides of transition metals selected from Groups IVB-VIB of the Periodic Table. Tungsten carbide powder, for example, can be added to the vessel for milling operations described herein. Depending on desired compositional parameters of the grade powder, additions of TiC, TaC and/or NbC powder can be mixed with the tungsten carbide powder in the vessel. Additionally, ceramic particles of other compositions can be milled or comminuted according to methods described herein. For example, various metal nitride, carbonitride and/or oxide compositions can be milled according to methods described herein.

Further, metallic binder can be added to the vessel as part of the particulate composition. Suitable metallic binder can comprise powdered cobalt or cobalt alloy. Powdered cobalt alloy can include alloying elements of nickel, chromium and/or iron. The particulate composition can comprise metallic binder in an amount of 1-25 weight percent with the balance transition metal carbide. In some embodiments, the particulate composition comprises metallic binder in an amount selected from Table I with the balance carbide powder.

TABLE I

| Metallic Binder Content of Particulate Composition<br>Metallic Binder (wt. %) |
|---|
| 2-20 |
| 5-15 |
| 6-12 |
| 1-5 |

An additive is also placed into the vessel with the particulate composition and milling media. The additive comprises a composition operable to undergo evaporation or sublimation when added to the vessel to provide a non-oxidative atmosphere in the vessel for the milling operation. In some embodiments, the additive comprises a composition operable to undergo evaporation or sublimation at or near room temperature. An additive, for example, can comprise solid carbon dioxide (dry ice) or liquid nitrogen. When liquid nitrogen is employed as the additive, the non-oxidative atmosphere is also an inert atmosphere.

The additive can be present in the vessel in an amount sufficient to provide the non-oxidative atmosphere at a positive pressure, thereby obstructing or precluding the ingress of ambient air or oxygen. In some embodiments, the additive is present in the vessel in an amount sufficient to provide the non-oxidative atmosphere at a positive pressure of 1.05-1.2 atm during comminution of the particulate carbide. As described further herein, pressures of the non-oxidative atmosphere exceeding 1.2 atm can be relieved by one or more venting structures of the vessel. A sufficient amount of additive for providing the non-oxidative atmosphere at a desired positive pressure during the milling operation can be determined or approximated using the ideal gas law or modified ideal gas law, wherein variables such as temperature, vessel volume and molecular mass of the additive are selected according to the specific parameters of the milling apparatus employed. In some embodiments, excess additive is placed in the vessel to compensate for partial loss of the non-oxidative atmosphere during the milling process resulting from leaks in the vessel and/or venting due to temperature fluctuations.

Providing a non-oxidative atmosphere can obviate the use of milling liquid in the vessel. In some embodiments of methods described herein, organic or inorganic milling liquids are not added to the vessel and comminution of the carbide particles is administered in a dry environment. The ability to conduct solvent-free milling according to methods described herein eliminates problems and inefficiencies associated with the use of organic and/or inorganic solvents including, handling and disposal restrictions, carbide drying techniques such as spray drying, and cost of the solvent.

With the non-oxidative atmosphere established, the particulate carbide is comminuted by the milling media to the desired particle size. In some embodiments, for example, the particulate carbide is comminuted to an average particle size in the range of 1-10 μm or 1-5 μm. Duration of the milling process can be dependent on several factors including chemical identity of the carbide, desired particle size of the milled carbide, type of milling apparatus used (ball mill, attritor) and/or identity of the milling media. In some embodiments described herein, milling is administered for a time period of 10 to 50 hours or 20 to 40 hours. In embodiments wherein the particulate composition also comprises metallic binder, the milling process is administered for a time period sufficient to distribute the metallic binder throughout the powder carbide. The metallic binder can be uniformly or substantially uniformly distributed throughout the powder carbide. Carbide particles, for example, can be coated with the powder metallic binder.

A pressing additive or lubricant can also be added to the vessel. Suitable pressing additives can comprise various waxes, such paraffin wax. Pressing additive can coat the carbide particles further inhibiting oxidation and assisting in powder consolidation in green foliating procedures.

After completion of the milling process, the particulate composition comprising comminuted carbide particles and metallic binder is removed from the vessel. In embodiments of solvent-free milling, removal of the particulate composition can be accomplished by a variety of methods, including vibrating or tapping the vessel. The carbide powder milled under the non-oxidative atmosphere and in the absence of milling liquid, in some embodiments, does not demonstrate lumping or significant agglomeration. Once removed, the carbide powder and associated metallic binder can be sieved to provide grade powder of desired particle size. For example, the carbide powder and associated metallic binder can be sieved using mesh size 900 (DIN-4188) to provide grade powder having particle size less than 5 μm.

The grade powder can be consolidated into the desired shape in the production of cemented carbide articles. Consolidation of grade powder into the desired shape can be administered through several techniques including uniaxial die pressing, cold isostatic pressing, extrusion or injection molding. The consolidation technique employed can be dependent on the classification or intended use of the cemented carbide article. Cutting inserts and mining tools, for example, can be pill pressed at pressure of 50 to 150 MPa. Further, rods or wires can be formed by extrusion processes. Consolidated grade powder can also be subjected to green shaping to provide the desired shape of the article.

The green compact is subsequently sintered to provide the cemented carbide article. Green compacts can be sintered under any conditions not inconsistent with the objectives of the present invention. A green compact, for example, can be vacuum sintered at a temperature of 1350° C. to 1560° C. Vacuum sintering can be combined with hot isostatic pressing (HIP) providing a sinter-HIP technique. In some embodiments, hot isostatic pressing is administered as a post-sintering operation. Heating rates during vacuum sintering are carefully controlled to permit decomposition of pressing additive/lubricant and proper completion of carbon-oxygen degassing reactions prior to pore closure. Generally, sintering dwell times can range from 15-120 minutes. The cemented carbide article is cooled to room temperature over a period of 2-4 hours and removed from the furnace. The cemented carbide article can be further machined or subjected to other post-sinter forming operations to provide the desired shape, dimensions or finish of the cemented carbide article. Cemented carbide articles produced according to methods described herein can be end mills, drills or indexable cutting inserts of desired ANSI standard geometry. Additionally, cemented carbide articles can be wires, rods dies, pellets, rolls, wear parts or any other mechanical parts of desired shape and size.

A cemented carbide article produced according to methods described herein, including solvent-free methods, can demonstrate values of hardness, coercivity, magnetic saturation, density and average sintered grain size as set forth in Tables II-VI

TABLE II

| Hardness of Cemented Carbide Article (HV30)<br>Hardness (HV30) |
|---|
| 700-900 |
| 900-1350 |
| 950-1050 |
| 900-1000 |
| 900-950 |
| 1230-1330 |
| 1250-1300 |
| 1300-1500 |
| 1500-1850 |

HV30 refers to Vickers Hardness using a 30 kilogram-force load. Vickers Hardness values recited herein are determined according to ASTM E 384—Standard Methods for Knoop and Vickers Hardness Materials.

TABLE III

| Coercive Force (Oe)<br>Coercive Force (Oe) |
|---|
| 60-155 |
| 60-85 |
| 60-70 |
| 125-155 |
| 125-135 |
| 45-350 |

Coercivity values recited herein are determined according to ASTM B887—Standard Test Method for Determination of Coercivity (Hcs) of Cemented Carbides.

TABLE IV

| Magnetic Saturation ($\mu Tm^3/kg$)<br>Magnetic Saturation ($\mu Tm^3/kg$) |
|---|
| 5-25 |
| 10.5-14.5 |
| 19.5-23.3 |
| 20-22 |
| 22-50 |

Magnetic saturation values recited herein are determined according to ASTM B 886-12—Standard Test Method for Determination of Magnetic Saturation. As known to one of skill in the art, magnetic saturation values may be converted between $\mu Tm^3/kg$ and percentages based on a nominally pure Co binder phase. For example, see Roebuck, B. Magnetic Moment (Saturation) Measurements on Hardmetals, *Int. J. Refractory Metals & Hard Materials,* 14 (1996) 419-424.

TABLE V

| Cemented Carbide Article Density ($g/cm^3$)<br>Density ($g/cm^3$) |
|---|
| 11.0-13.8 |
| 13.8-14.5 |
| 13.8-14.2 |
| 13.9-14.1 |
| 14.2-14.5 |
| 14.5-15.3 |

TABLE VI

| Average Sintered Grain Size (μm) |
|---|
| Average Sintered Grain Size (μm) |
| <1-3 |
| 3-6 |
| 3.5-6 |
| 2.0-3.0 |
| 6.0-8.0 |

Average grain size of a cemented carbide article produced according to methods described herein is determined according to Lineal Intercept Method as set forth in ASTM E112-10 Standard Test Methods for Determining Average Grain Size.

A cemented carbide article can have any combination of the foregoing properties. For example, a cemented carbide article can demonstrate any combination of hardness, coercivity, magnetic saturation, density and average sintered grain size selected from Tables II-VI.

II. Apparatus for Milling Carbide

In a further aspect, apparatus for milling carbide are described herein. An apparatus for milling carbide comprises a vessel and milling media in the vessel. The vessel also comprises an additive undergoing evaporation or sublimation to provide a non-oxidative atmosphere in the vessel for the milling operation.

Vessels and milling media suitable for use in apparatus described herein can have any construction and/or properties recited in Section I hereinabove. In some embodiments, for example, a suitable vessel is a milling drum of a ball mill or a tank of an attritor. Further, milling media can be formed of carbon steel, chrome steel, stainless steel, alloy, carbide including tungsten carbide, ceramic, zirconium or flintstones. Tungsten carbide milling media can be cemented tungsten carbide with cobalt or cobalt alloy binder. Moreover, ceramic milling media includes silicon nitride, silicon carbide, steatite, alumina, zirconium toughened alumina and zirconium oxide stabilized with magnesia, yttria or rare earth.

As described in Section I herein, the additive in the vessel of the apparatus comprises a composition undergoing evaporation or sublimation to provide a non-oxidative atmosphere in the vessel for the milling operation. In some embodiments, the additive comprises a composition operable to undergo evaporation or sublimation at or near room temperature. An additive, for example, can comprise solid carbon dioxide (dry ice) or liquid nitrogen. The additive can be present in the vessel in an amount sufficient to provide the non-oxidative atmosphere at a positive pressure, thereby obstructing or precluding the ingress of ambient air or oxygen. The additive, for example, can be present in the vessel in an amount sufficient to provide a non-oxidative atmosphere at a pressure of 1.05 to 1.2 atm. The apparatus can comprise venting structures to alleviate pressure build-up during the milling process. In some embodiments, the vessel comprises one or more vents sealed with gaskets. When pressure in the vessel exceeds a predetermined value, the vents open expelling excess pressure.

These and other embodiments are further illustrated in the following non-limiting examples.

Example 1

Particulate compositions of tungsten carbide (WC) and metallic binder were ball milled (drum capacity 8 L) under a non-oxidative atmosphere of $CO_2$ in the absence of milling liquid according to the parameters of Table VII. As described herein, the non-oxidative atmosphere of $CO_2$ was provided by adding dry ice (solid $CO_2$) to the mill drum as set forth in Table VII.

TABLE VII

Solvent-free Ball Milling of WC Powder and Metallic Binder

| Particulate Composition (Batch No.) | WC (wt. %) | Metallic Binder (wt. %) | Batch Size (kg) | Additive Solid $CO_2$ (g) | Wax Type (%) | Milling Ball (WC-Co) wt. (kg) | Milling Ball diameter (mm) | Milling Time (hrs) |
|---|---|---|---|---|---|---|---|---|
| 1 | 85 | 15 (Co—Ni—Cr) | 2 | 20-30 | IGI 0.5 | 15 | 15 | 24 |
| 2 | 85 | 15 (Co—Ni—Cr) | 5 | 20-30 | None | 28 | 15 | 24 |
| 3 | 85 | 15 (Co—Ni—Cr) | 5 | 20-30 | IGI 0.5 | 28 | 15 | 24 |
| 4 | 88 | 12 (Co) | 5 | 20-30 | None | 28 | 9 | 40 |

The milled tungsten carbide powder compositions (1-4) were sieved using mesh size 900 (DIN 4188) to provide grade powders for production of cemented tungsten carbide articles by sintering.

For comparative purposes particulate compositions (5-6) of tungsten carbide and metallic binder were ball milled (drum capacity 8 L) using water or acetone as the milling liquid according to the parameters of Table VIII.

TABLE VIII

Ball Milling of WC Powder and Metallic Binder

| Particulate Composition (Batch No.) | WC (wt. %) | Metallic Binder (wt. %) | Batch Size (kg) | Milling Liquid | Wax Type (%) | Milling Ball (WC-Co) wt. (kg) | Milling Ball diameter (mm) | Milling Time (hrs) |
|---|---|---|---|---|---|---|---|---|
| 5 | 85 | 15 (Co—Ni—Cr) | 5 | Water | IGI 0.5 | 28 | 15 | 24 |
| 6 | 88 | 12 (Co) | 5 | Acetone | None | 28 | 9 | 40 |

The milled tungsten carbide powder compositions (5-6) were sieved using mesh size 900 (DIN 4188) to provide comparative grade powders for production of cemented tungsten carbide articles by sintering.

Grade powder compositions (1-4) produced according to solvent-free methods described herein and comparative grade powder compositions (5-6) were vacuum sintered according to the parameters set forth in Table IX to provide cemented tungsten carbide articles.

TABLE IX

Sintering of Grade Powders

| Cemented Carbide Article | Grade Powder | Sintering Condition | Hipping Condition | Sample Size | Coercive Force ($O_e$) | Magnetic Saturation ($\mu Tm^3/kg$) | HV30 | Density ($g/cm^3$) |
|---|---|---|---|---|---|---|---|---|
| A | 1 | 1430° C., 1 hr. dwell | none | Rod Test | 65.4-66.6 | 11.9 | 960-966 | 14.042 |
| B | 1 | 1430° C., 1 hr. dwell | 1340° C., 1000 bar | Rod Test | 63 | 11.6 | 971 | 14.051 |
| C | 2 | 1425° C., 1 hr. dwell | none | Rod Test | 59.6-60.4 | 12.7 | 911 | 14.028 |
| D | 2 | 1425° C., 1 hr. dwell | 1340° C., 1000 bar | Rod Test | 58 | 13.1 | 915-917 | 14.054 |
| E | 3 | 1430° C., 1 hr. dwell | none | Rod Test | 63.5-63.6 | 14.4 | 923-927 | 13.991 |
| F | 3 | 1430° C., 1 hr. dwell | 1340° C., 1000 bar | Rod Test | 63.1 | 14.2 | 939-943 | 13.992 |
| G | 4 | 1425° C., 1 hr. dwell | None | SNUN | 127-128 | 21.1-21.3 | 1255-1265 | 14.338 |
| H | 5 | 1430° C., 1 hr. dwell | 1340° C., 1000 bar | Rod Test | 66 | 13.2 | 1005 | 13.994 |
| I | 6 | 1425° C., 1 hr. dwell | none | SNUN | 119 | 22.7 | 1251 | 14.299 |

Figure 2:
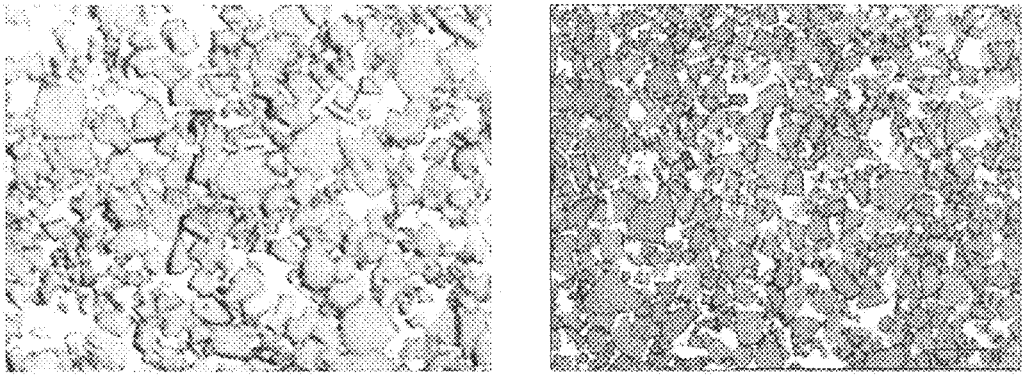
FIG. 2 illustrates cemented tungsten carbide produced according to one embodiment of a method described herein in comparison to a prior method.
Figure 3:
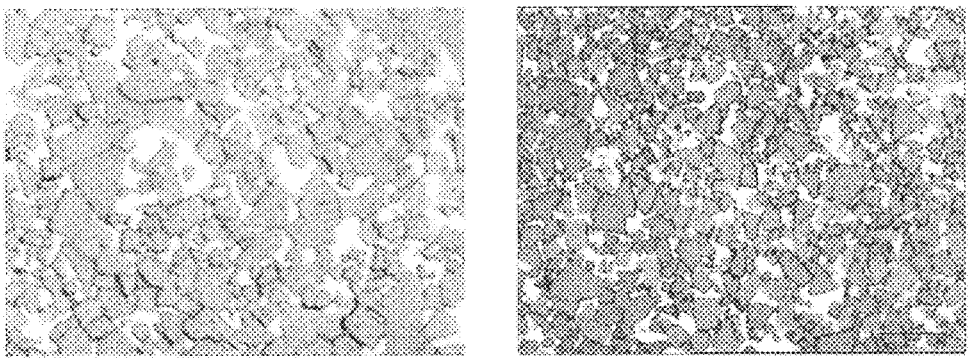
FIG. 3 illustrates cemented tungsten carbide produced according to one embodiment of a method described herein in comparison to a prior method.
Figure 4:
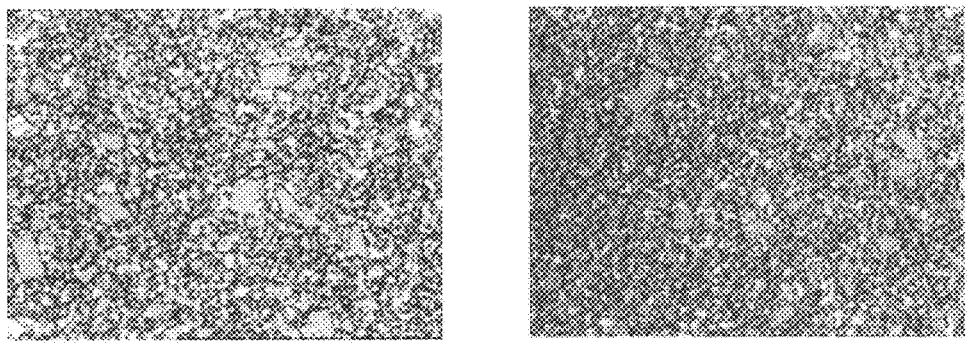
FIG. 4 illustrates cemented tungsten carbide produced according to one embodiment of a method described herein in comparison to a prior method.

As set forth in Table IX, grade powders (1-4) produced according to solvent-free methods described herein provided cemented tungsten carbide articles having properties consistent with cemented tungsten carbide articles formed of grade powders (5-6) produced by traditional milling methods employing milling liquid. Further, FIGS. 1-4 demonstrate similarities in microstructure between cemented tungsten carbide articles formed of grade powders (1-4) produced by solvent-free milling methods described herein and cemented carbide articles formed of grade powders (5-6) produced by methods employing milling liquid. FIG. 1, for example, provides an SEM image of cemented tungsten carbide article B [FIG. 1(*a*)] and comparative cemented tungsten carbide article H [FIG. 1(*b*)] of Table IX. As illustrated in FIG. 1, the microstructures of cemented carbide articles B and H are substantially similar. FIGS. 2 and 3 illustrate results similar to FIG. 1. Cemented tungsten carbide article D [FIG. 2(*a*)] displayed a microstructure similar to comparative cemented tungsten carbide article H [FIG. 2(*b*)] while cemented tungsten carbide article F [FIG. 3(*a*)] also demonstrated a microstructure similar to comparative cemented carbide article H [FIG. 3(*b*)].

Furthermore, changing grade powder composition did not alter the microstructural similarities between cemented tungsten carbide articles formed of grade powder produced by solvent-free milling methods described herein and cemented carbide articles formed of grade powder produced by methods employing milling liquid. For example, cemented carbide article G [FIG. 4(*a*)] of Table IX displayed a microstructure similar to comparative cemented carbide article I [FIG. 4(*b*)].

Various embodiments of the invention have been described in fulfillment of the various objects of the invention. It should be recognized that these embodiments are merely illustrative of the principles of the present invention. Numerous modifications and adaptations will be readily apparent to those skilled in the art without departing from the spirit and scope of the invention.

We claim:

1. A method of milling carbide comprising:

placing a particulate composition comprising carbide in a vessel containing milling media;

placing an additive in the vessel, the additive undergoing evaporation or sublimation to provide a non-oxidative atmosphere in the vessel; and comminuting the carbide particles with the milling media in the non-oxidative atmosphere in the absence of milling liquid and in the absence of the additive in solid or liquid form.

2. The method of claim 1, wherein the carbide particles comprise one or more transition metal carbides.

3. The method of claim 2, wherein transition metal of the carbide is selected from Group IVB, VB or VIB of the Periodic Table.

4. The method of claim 1, wherein the additive is placed in the vessel in an amount sufficient to provide the non-oxidative atmosphere at a positive pressure.

5. The method of claim 4, wherein the positive pressure is in the range of 1.05 to 1.2 atm.

6. The method of claim 4 further comprising venting the non-oxidative atmosphere to maintain the positive pressure at 1.2 atm or less.

7. The method of claim 1, wherein the additive comprises solid carbon dioxide.

8. The method of claim 1, wherein the additive comprises liquid nitrogen.

9. The method of claim 1 further comprising removing the comminuted carbide powder from the vessel.

10. The method of claim 1, wherein the vessel is a drum of a ball mill.

11. The method of claim 1, wherein the vessel is an attritor tank.

12. The method of claim 1, wherein the carbide particles are tungsten carbide particles.

13. The method of claim 1, wherein the particulate composition further comprises metallic binder.

14. The method of claim 13, wherein the metallic binder is cobalt or a cobalt alloy.

15. The method of claim 13, wherein the metallic binder is present in the particulate composition in an amount of 1 to 25 weight percent.

16. A method of making a cemented carbide article comprising:

placing a particulate composition comprising carbide and metallic binder in a vessel containing milling media;

placing an additive in the vessel, the additive undergoing evaporation or sublimation to provide a non-oxidative atmosphere in the vessel;

comminuting the carbide particles with the milling media in the non-oxidative atmosphere in the absence of milling liquid and in the absence of the additive in solid or liquid form;

consolidating the comminuted carbide particles into a green compact; and sintering the green compact to provide the cemented carbide article.

17. The method of claim 16, wherein the additive is placed in the vessel in an amount sufficient to provide the non-oxidative atmosphere at a positive pressure.

18. The method of claim 17, wherein the positive pressure is in the range of 1.05 to 1.2 atm.

19. The method of claim 17 further comprising venting the non-oxidative atmosphere to maintain the positive pressure at 1.2 atm or less.

20. The method of claim 16, wherein the additive comprises solid carbon dioxide.

21. The method of claim 16, wherein the additive comprises liquid nitrogen.

22. The method of claim 16, wherein the vessel is a drum of a ball mill.

23. The method of claim 16, wherein the vessel is an attritor tank.

24. The method of claim 16, wherein the carbide particles are tungsten carbide particles.

25. The method of claim 16, wherein the metallic binder is cobalt or a cobalt alloy.

26. The method of claim 16, wherein the metallic binder is present in the particulate composition in an amount of 1 to 25 weight percent.

27. The method of claim 1, wherein the comminuted carbide particles have an average size of 1 μm to 10 μm.

28. A method of milling carbide comprising:

placing a particulate composition comprising carbide in a vessel containing milling media;

placing an additive in the vessel, the additive undergoing evaporation or sublimation to provide a non-oxidative atmosphere in the vessel; and comminuting the carbide particles with the milling media in the non-oxidative atmosphere to an average size of 1 μm to 10 μm in the absence of milling liquid and in the absence of the additive in solid or liquid form.

29. The method of claim 28, wherein the additive is solid carbon dioxide.

30. The method of claim 28, wherein the additive is placed in the vessel in an amount sufficient to provide the non-oxidative atmosphere at a positive pressure.

31. The method of claim 28, wherein the carbide particles comprise one or more transition metal carbides.

32. The method of claim 28, wherein comminution of the carbide particles is administered in a dry environment.

* * * * *